United States Patent [19]

Roberts

[11] Patent Number: 4,875,024

[45] Date of Patent: Oct. 17, 1989

[54] LOW LOSS POWER SPLITTER

[75] Inventor: Thomas E. Roberts, Saratoga, Calif.

[73] Assignee: Ford Aerospace Corporation, Newport Beach, Calif.

[21] Appl. No.: 279,757

[22] Filed: Dec. 5, 1988

[51] Int. Cl.[4] ..... H01P 5/12

[52] U.S. Cl. ..... 333/127; 333/128

[58] Field of Search ..... 333/127, 128

[56] References Cited

U.S. PATENT DOCUMENTS

| | | | |
|---|---|---|---|
| 3,091,743 | 5/1963 | Wilkinson . | |
| 4,254,386 | 3/1981 | Nemit et al. | 333/128 |
| 4,401,955 | 8/1983 | Yorinks et al. | 333/127 |
| 4,450,418 | 5/1984 | Yum et al. | 333/128 |
| 4,595,891 | 6/1986 | Cronauer | 333/127 |
| 4,639,694 | 1/1987 | Seino et al. | 333/128 |
| 4,721,929 | 1/1988 | Schnetzer | 333/127 |
| 4,725,792 | 2/1988 | Lampe, Jr. | 333/128 X |

FOREIGN PATENT DOCUMENTS

| | | | |
|---|---|---|---|
| 2170358 | 7/1986 | United Kingdom | 333/128 |

OTHER PUBLICATIONS

Wahi, *Wideband, Unequal Split Ratio Wilkinson Power Divider,* Microwave Journal, Sep. 1988, pp. 205–209.

*Primary Examiner*—Paul Gensler

*Attorney, Agent, or Firm*—Edward J. Radlo; Keith L. Zerschling

[57] ABSTRACT

Apparatus for dividing and combining electromagnetic energy, particularly at microwave frequencies. An input port (4) is positioned generally equidistant from each of n output ports (5,6;31,32,33 . . . ), where n is a finite integer greater than 1. n quarter-wavelength impedance transforming conductors (20;41,42,43 . . . ) couple the input port (4) to the n output ports (5,6;31,32,33 . . . ), respectively. Positioned between each pair of adjacent output ports (5,6;31,32,33) is an isolation resistor (7). A pair of half-wavelength unity impedance transformers (21) couples each isolation resistor (7) to its two associated output ports (5,6;31,32,33 . . . ), respectively. The invention allows greater geometrical freedom than prior art splitters, and offers a lower loss for a given frequency.

7 Claims, 3 Drawing Sheets

LOW LOSS POWER SPLITTER

DESCRIPTION

1. Technical Field

This invention pertains to the field of combining and dividing electromagnetic energy, particularly at microwave frequencies.

2. Background Art

U.S. Pat. No. 3,091,743 discloses a multiport microwave power splitter having isolated output ports.

U.S. Pat. No. 4,401,955 discloses a microwave power splitter having lumped LC circuit elements located between an isolation resistor and output ports.

U.S. Pat. No. 4,254,386 shows several different types of power splitters, including, in FIG. 1A, a hybrid ring coupler, in which a shunt resistor is used between an isolation port and ground, and quarter-wave sections are present between the isolation port and two output ports.

Other examples of power splitters are shown in U.S. Pat. Nos. 4,450,418, 4,639,694, and 4,721,929.

DISCLOSURE OF INVENTION

The invention is an apparatus for splitting (dividing and combining) electromagnetic energy. There can be n output ports (5, 6; 31, 32, 33 . . . ), where n is any finite integer greater than 1. An input port (4) is positioned generally equidistant from each of the n output ports (5, 6; 31, 32, 33 . . . ). n impedance transforming conductors (20; 41, 42, 43 . . . ) couple the input port (4) to the n output ports (5, 6; 31, 32, 33 . . . ), respectively. Each impedance transforming conductor (20; 41, 42, 43 . . . ) is substantially a quarter of a wavelength long. Positioned between each pair of adjacent output ports (5, 6; 31, 32, 33 . . . ) is an isolation resistor (7). A pair of unity impedance transformers (21) couples each isolation resistor (7) to its two associated output ports (5, 6; 31, 32, 33 . . . ), respectively. Each unity impedance transformer (21) is substantially a half-wavelength long.

BRIEF DESCRIPTION OF THE DRAWINGS

These and other more detailed and specific objects and features of the present invention are more fully disclosed in the following specification, reference being had to the accompanying drawings, in which.

BEST MODE FOR CARRYING OUT THE INVENTION

Figure 1:
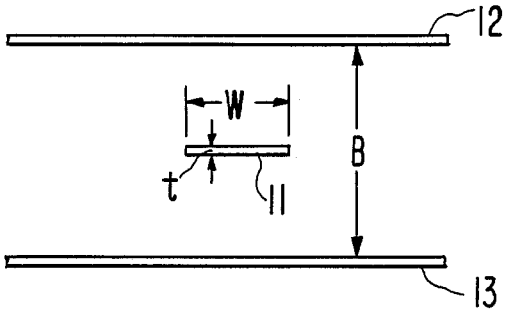
FIG. 1 is a cross-section sketch showing parameters of the stripline configuration in which the present invention is preferably embodied.
Figure 2:
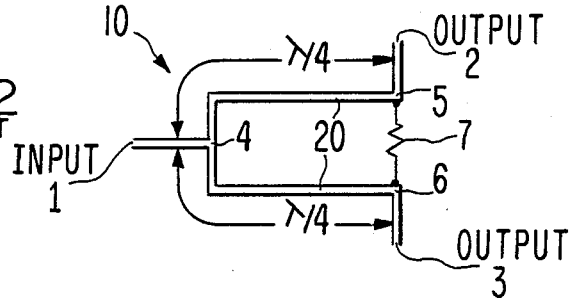
FIG. 2 PRIOR ART
FIG. 2 is a sketch of an isolated power splitter of the Wilkinson type.

Microwave signal or power distribution networks are often implemented in stripline because of the versatility and relatively low loss of this medium. Therefore, the present invention will be illustrated in a stripline embodiment, although other possibilities, such as coaxial line, may be used. Another word for "stripline" is "barline". With respect to FIG. 1, stripline consists of a conductor 11 centered between parallel conductive plates 12, 13. Conductor 11 is connected externally to other elements, such as radiators, receivers, or transmitters, by means of junctions, which may be perpendicular or parallel to the plates 12,13. Conductor 11 can comprise various elements, such as items 1, 2, 3, 8, 9, 20, 21, 41, 42, and 43, shown in the Figures.

A commonly used type of power splitter is a Wilkinson power splitter 10, illustrated in FIGS. 2–5. This splitter 10 features an isolated output, which is achieved by inserting an isolation resistor 7 between the two output ports 5, 6. As used herein, "isolated output" means that power flowing into one of the output ports 5, 6 will not exit the other output port 6,5. In a balanced even-split circuit, half of the power will exit the input port 4 and half will be dissipated in resistor 7. This feature can be very useful in many types of circuits, e.g., where the outputs 2, 3 are fed to radiators and there is a possibility of a reflected wave coming back into the splitter 10 from the radiators.

The Wilkinson splitter 10 in its most basic embodiment is a three port device having an input conductor 1 (with an input port 4 at one end thereof) and two output conductors 2, 3 (with an output port 5, 6 at one end of each). Isolation resistor 7 may in some sense be considered to be an unavailable fourth port. Two quarter-wavelength-long impedance transforming conductors 20 couple the input port 4 with the two output ports 5, 6, respectively. The output signals appearing at output ports 5, 6 are in phase.

As is true for couplers generally, the splitter 10 can be used as a power divider and as a power combiner. When power is applied at input port 4, it is divided between the two output ports 5, 6. When power is applied at the output ports 5, 6, it is combined and appears at input port 4. Thus, the terminology "input" and "output" is somewhat arbitrary and relates to the special case where splitter 10 is used as a divider. It will be assumed throughout that the splitters described herein can equally be used as dividers and combiners, and that the law of reciprocity pertains thereto.

Figure 3:
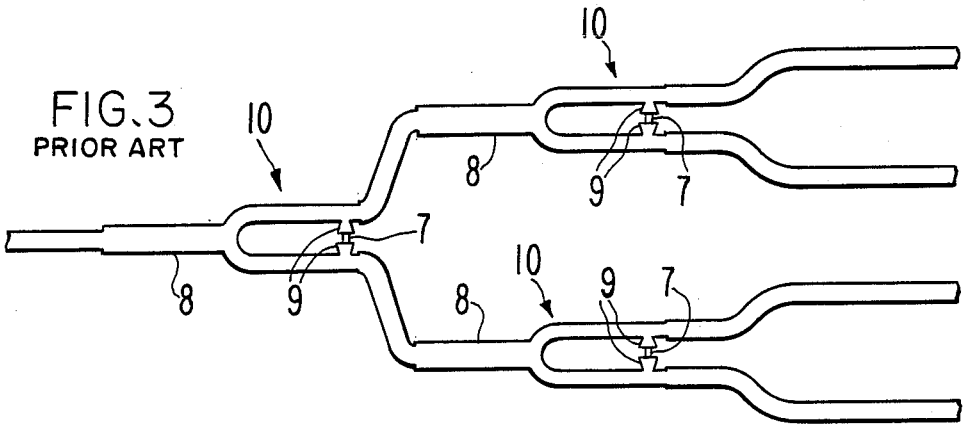
FIG. 3 PRIOR ART
FIG. 3 is a circuit tracing showing how three Wilkinson power splitters can be used together in a circuit.

FIG. 3 illustrates how several Wilkinson splitters 10 can be used in a single circuit. Notice the varying widths of the conductors 8, 10. This is a design technique to maximize the impedance match over a broad bandwidth. FIG. 3 also illustrates the use of stubs 9 as anchor posts for the isolation resistors 7. The leads to resistors 7 are kept as short as possible to avoid series inductance between the output ports 5, 6, which would degrade the bandwidth.

Figure 5:
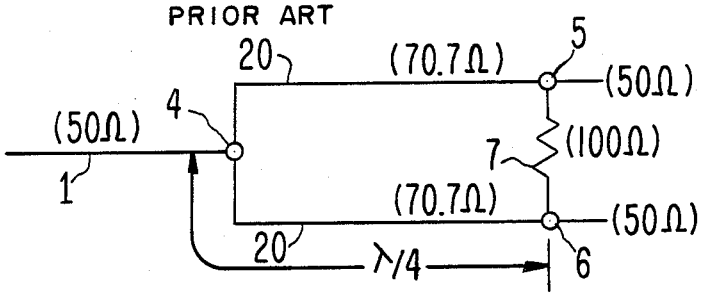
FIG. 5 PRIOR ART
FIG. 5 is a circuit diagram of a Wilkinson power splitter.

FIG. 5 illustrates the impedances present in the Wilkinson splitter 10. The input impedance and the output impedances are typically 50 ohms, and the value of resistor 7 is typically 100 ohms. The quarter-wavelength impedance transforming sections 20 must be 70.7 ohms. This is because from the point of view of input port 4, it is desired to transform each of the 50 ohm output impedances to 100 ohms, since two 100 ohm impedances in parallel are equivalent to 50 ohms. As is well known in the transmission line art, a 70.7 ohm quarter wavelength section will transform 50 ohms to 100 ohms.

The Wilkinson splitter 10 offers symmetry, compactness, and ease of design. Varying the widths of the various conductors 1, 2, 3, 20 can result in bandwidth broadening, often a required feature.

Figure 4:
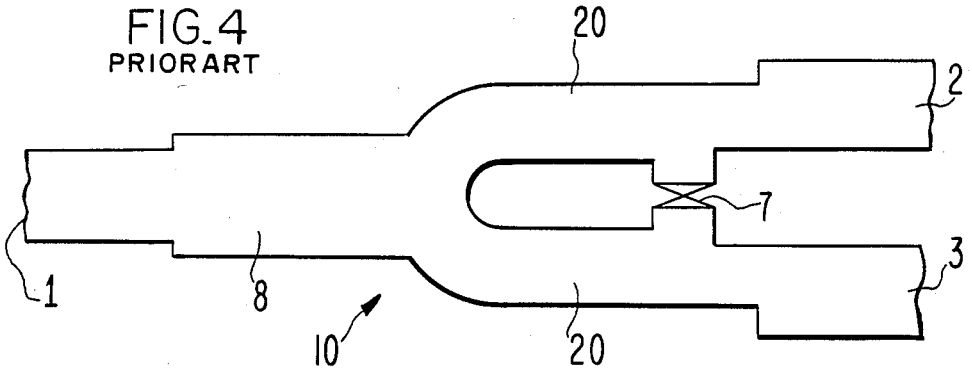
FIG. 4 PRIOR ART
FIG. 4 is a circuit tracing of a Wilkinson power splitter used with high interplate spacing B.

A problem with the Wilkinson splitter 10, however, is that at the higher microwave frequencies, it becomes more difficult to achieve the desired results. The widths W of the conductive elements 11 must be kept approximately (depending upon their thickness t) proportional to the plate spacing B in order to keep the impedance of the circuit constant. In this case, attenuation due to loss within conductor 11 is inversely proportional to the spacing B between the parallel plates 12, 13 (see FIG. 1). Therefore, it is generally desirable to keep this spacing B as large as possible. But as the frequency goes up, the lengths of the conductors, in particular quarter-wave sections 20, gets smaller and smaller because these lengths are inversely proportional to the operating frequency. At some point, the lengths of the conductors 20 will be as small as their widths. FIG. 4, which covers the same frequency as FIG. 3, illustrates this phenomenon of geometrical overcrowdedness. As a result, the designer is forced to decrease the widths. This requires a concomitant decrease in B to keep the impedance constant, which results in increased loss.

For the frequency band 3.4 GHz to 4.2 GHz, and a spacing B of 0.105 inches, calculated losses for conductive elements 11 are 0.14 dB per foot in the case of copper. Measured copper losses have been 50% higher than calculated losses. As indicated above, these copper losses could be reduced by increasing the plate spacing B, and the width W, but at some point W becomes unacceptably large.

Another problem with the Wilkinson splitter 10 at high frequencies is that the required fabrication precision is proportional to the operating frequency. This precision is difficult to accomplish under conditions of geometrical overcrowdedness as illustrated in FIG. 4.

Figure 6:
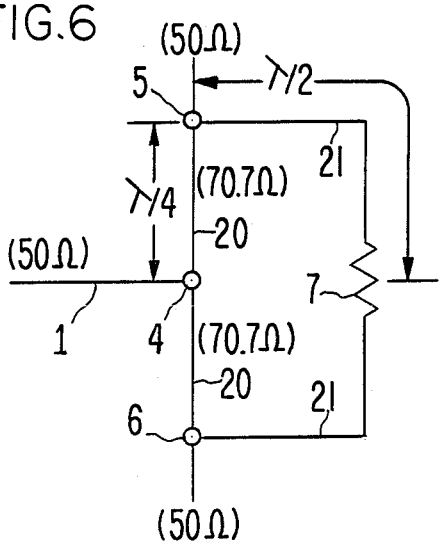
FIG. 6 is a circuit diagram of the power splitter of the present invention.
Figure 7:
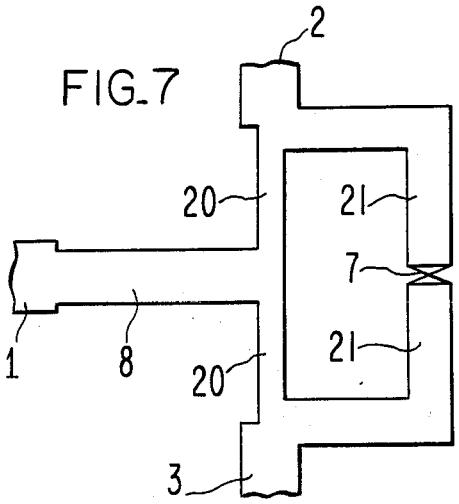
FIG. 7 is a circuit tracing of a first embodiment of the prevent invention.
Figure 8:
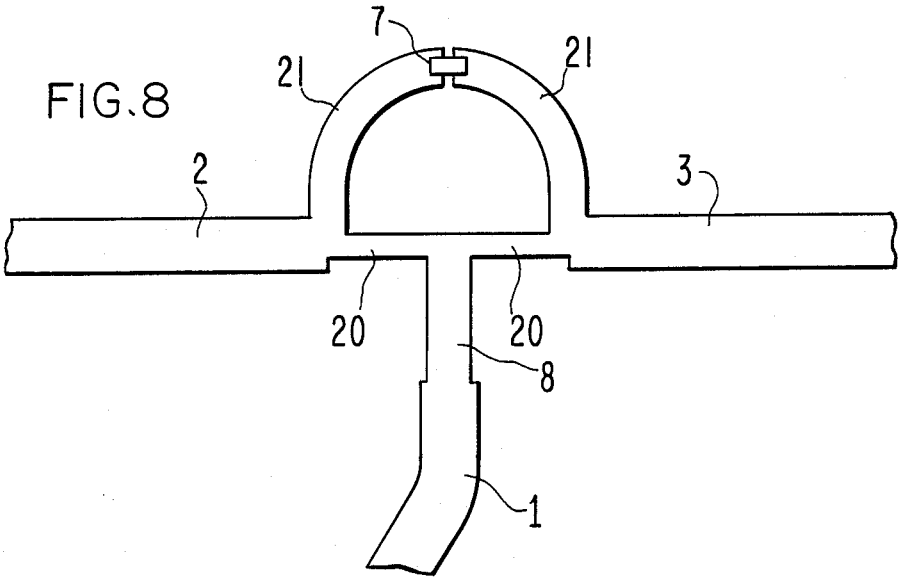
FIG. 8 is a circuit tracing of a second embodiment of the present invention.

As shown in FIGS. 6 through 8, the present invention solves the above problems by inserting a pair of half-wavelength sections 21 between the isolation resistor 7 and the output ports 5, 6. Each section 21 acts as a unity (1:1) impedance transformer. This allows the output ports 5, 6 to be up to half a wavelength apart (the maximum distance allowed by the quarter-wavelength sections 20), rather than constraining them to be immediately adjacent to each other as in the prior art devices. This solves the geometrical problems described above, results in lower loss, eases the requirement on manufacturing tolerances, and minimizes even further any possibility of coupling between the two output ports 5, 6.

As illustrated in FIG. 7, the circuit can be made to cover a braoder band by means of inserting an additional quarter-wavelength impedance transforming conductor 8 between the input conductor 1 and the original two quarter-wavelength sections 20. In a device actually constructed, the width of section 8 was 224 mils and its length was 840 mils; the widths of conductors 1, 2, and 3 were each 286 mils; the widths of conductors 20 were 134 mils and their lengths were 745 mils; and the widths of conductors 21 were 208 mils and their lengths were 1473 mils. Resistor 7 had a value of 100 ohms, and the interplate spacing B was 0.210 inch.

FIG. 8 shows a working embodiment in which half-wave sections 21 are arcuate in shape. The measured performance of the splitter illustrated in FIG. 8 showed excellent amplitude, phase balance, isolation, and insertion loss characteristics over the frequency band 3.4 GHz to 4.2 GHz. The FIG. 8 embodiment was built with a total of 12 inches of transmission line with a loss of 0.14 dB per foot. The net loss of the splitter at mid-band was 0.19 dB.

The relatively open physical size of the instant circuit represents a great advantage over the standard Wilkinson circuit at high frequency applications. The FIG. 7 device has the same plate spacing B as the FIG. 3 device: 0.210 inch. A comparison of FIG. 7 and FIG. 3 clearly shows the dimensional advantages of the new circuit for higher frequencies, where line widths and spacing are a significant fraction of a wavelength. In FIG. 3, the lines are so close that there may be significant coupling between them. There is crowding in the vicinity of isolation resistors 7. This could cause poor performance or require additional design effort. In FIG. 7, the lines are spaced well apart, and there is no crowding at isolation resistors 7. For a given frequency, the FIG. 7 circuit can be built with a larger W and therefore a larger B. The net result is lower loss.

The lengths of conductors 21 are not necessarily exactly half a wavelength long, but are substantially half a wavelength long. The exact lengths are adjusted to achieve a good impedance match over a broad bandwidth. The exact length depends slightly on the width of the adjacent quarter-wave sections 20 and on junction effects. Similarly, the lengths of the quarter-wavelengths section 20 are not necessarily exactly equal to a quarter wavelength.

Figure 9:
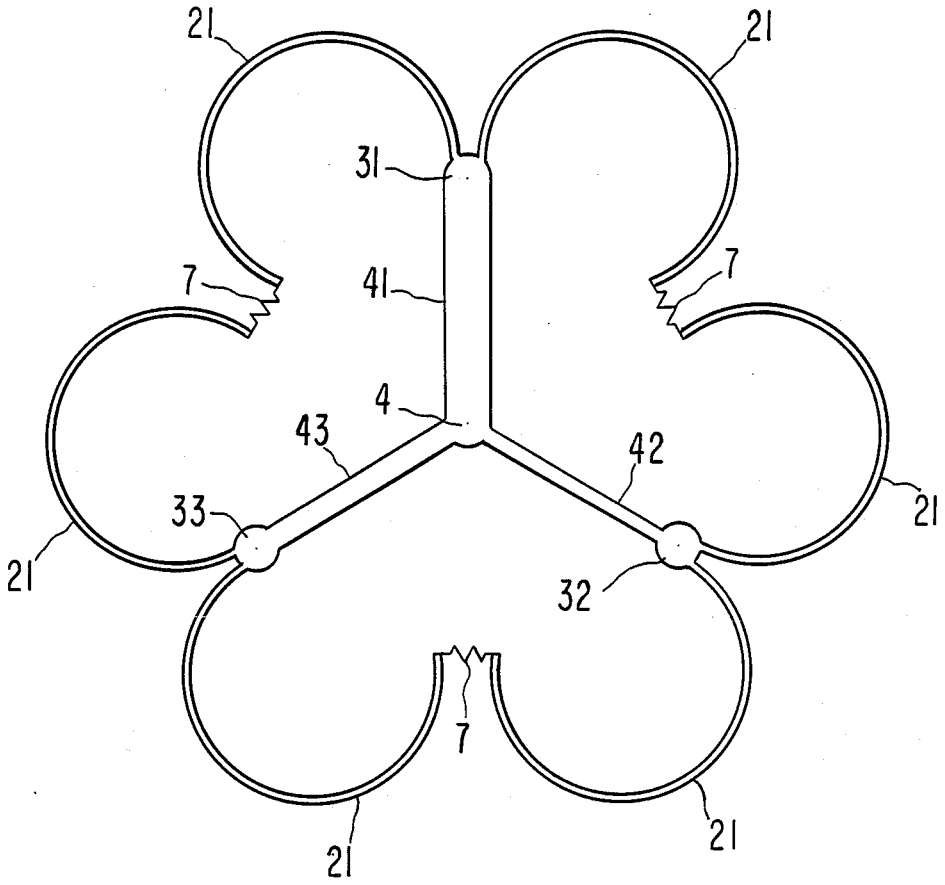
FIG. 9 is a sketch of a third embodiment of the present invention.

FIG. 9 illustrates a multi-port embodiment of the present invention, in which three output ports 31, 32, 33 are present. The number of output ports can be arbitrarily high, and the principles of the present invention would still pertain thereto. The input conductors and output conductors are not shown in FIG. 9; they may be positioned perpendicular to the plane of the page of FIG. 9.

As with the three-port embodiments, there is a quarter-wavelength section 41, 42, 43 coupling the sole input port 4 with each of the output ports 31, 32, 33 respectively. As shown in FIG. 9, the three quarter wavelength sections 41, 42, 43 have different widths. This causes unequal power division, i.e., an input power applied at input port 4 will be divided unequally among the three output ports 31, 32, 33. This unequal power division could likewise be used with the three-port embodiment depicted in FIGS. 6–8. If equal power division is desired, the widths of all of the quarter-wavelength sections 41, 42, 43 are made to be equal.

An isolation resistor 7 is positioned generally between each pair of adjacent output ports 31, 32, 33. A half-wavelength section 21 couples each end of each resistor 7 to its corresponding output port 31, 32, 33. As with the three-port embodiment, an additional quarter-wavelength impedance matching section can be inserted between the input conductor and quarter-wavelength sections 41, 42, 43.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. Apparatus for splitting electromagnetic energy, comprising:

an input conductor having an input port at one end thereof;

two output conductors, each having an output port at one end thereof;

first and second impedance transforming conductors that are each substantially a quarter of a wavelength long and that couple the input port to the two output ports, respectively;

an isolation resistor, having first and second ends, positioned between the two output ports; and first and second unity impedance transformers that couple the first and second ends of the isolation resistor, respectively, with the first and second output ports, respectively, wherein each unity impedance transformer is substantially one-half wavelength long.

2. The apparatus of claim 1 wherein the two impedance transforming conductors have the same width, so that when a source of input power is applied at the input port, equal amounts of power appear at the two output ports.

3. The apparatus of claim 1 wherein the two impedance transforming conductors have different widths, so that when a source of input power is applied at the input port, different amounts of power appear at the two output ports.

4. The apparatus of claim 1 further comprising a third impedance transforming conductor, substantially a quarter-wavelength long, interposed between the input port and the first and second impedance transforming conductors.

5. Apparatus for splitting electromagnetic energy, said apparatus comprising:

n output ports, where n is a finite integer greater than two;

an input port positioned generally equidistant from each of the n output ports; and n impedance transforming conductors that couple the input port to the n output ports, respectively; wherein:

each impedance transforming conductor is substantially a quarter of a wavelength long;

positioned between each pair of adjacent output ports is an isolation resistor;

a pair of unity impedance transformers couples each isolation resistor to its two associated output ports, respectively; and each unity impedance transformer is substantially a half-wavelength long.

6. The apparatus of claim 5 wherein each impedance transforming conductor has the same width, so that input power applied at the input port is equally divided at the output ports.

7. The apparatus of claim 5 wherein at least two of the impedance transforming conductors have different widths, so that input power applied at the input port is divided unequally at the output ports.

* * * * *